US005161997A

United States Patent [19]

Defibaugh et al.

[11] Patent Number: 5,161,997

[45] Date of Patent: Nov. 10, 1992

[54] HARDWARELESS PANEL RETENTION FOR SHIELDED CONNECTOR

[75] Inventors: George R. Defibaugh, Mechanicsburg; Earl C. Myers, Jr., Harrisburg; Robert N. Whiteman, Jr., Middletown, all of Pa.

[73] Assignee: AMP Incorporated, Harrisburg, Pa.

[21] Appl. No.: 776,511

[22] Filed: Oct. 11, 1991

[51] Int. Cl.[5] ..... H01R 13/514

[52] U.S. Cl. ..... 439/532; 439/540; 248/222.2

[58] Field of Search ..... 439/540, 532, 638, 639, 439/716; 248/222.2, 225.1; 361/419, 420, 427

[56] References Cited

U.S. PATENT DOCUMENTS 3,573,716 4/1971 Garver .
3,711,817 1/1973 Carter et al. ..... 439/540
4,156,804 5/1979 Piber .
4,241,972 12/1980 Ayer .
4,761,144 8/1988 Hunt, III et al. ..... 439/545
4,781,626 11/1988 Lazarchik ..... 439/680
4,824,387 4/1989 deJong et al. ..... 439/248
4,923,310 5/1990 Sekiguchi et al. ..... 439/540
5,055,067 10/1991 Field ..... 439/540
5,085,601 2/1992 Buchter et al. ..... 439/79

*Primary Examiner*—Gary F. Paumen
*Attorney, Agent, or Firm*—David L. Smith

[57] ABSTRACT

There is disclosed a hardwareless panel retention system in which an electrically conductive panel has opposed major surfaces with a mating connector aperture extending therebetween. The panel has opposed edges formed into a pair of channels. A connector having a housing with contacts secured therein is secured to the panel. A shield secured to the connector housing has a flange along opposed edges for receipt in respective opposed channels of the panel to secure the connector to the panel.

5 Claims, 9 Drawing Sheets

Fig. 4
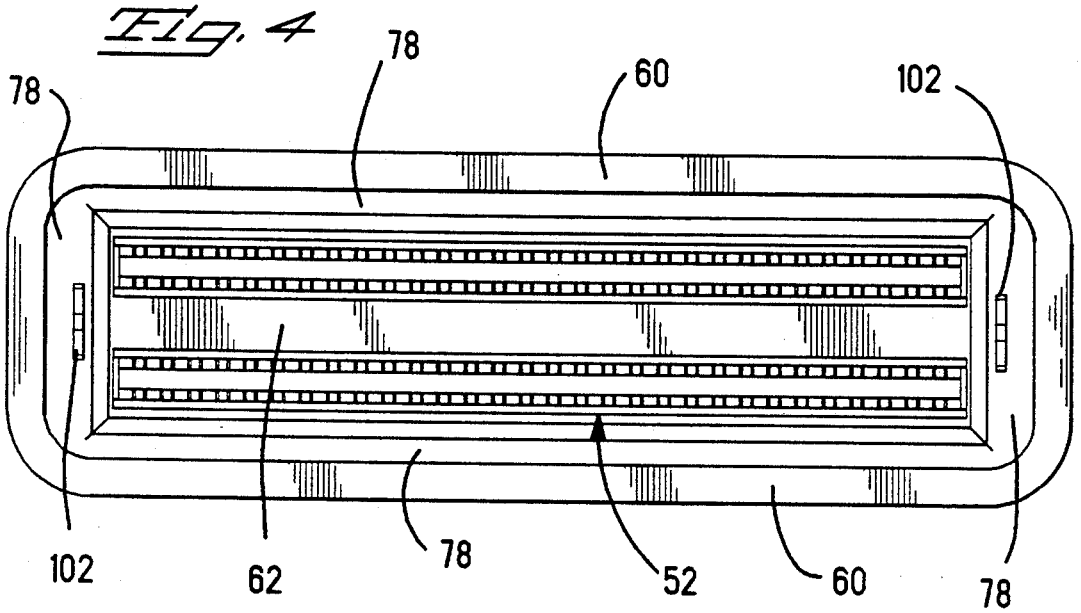
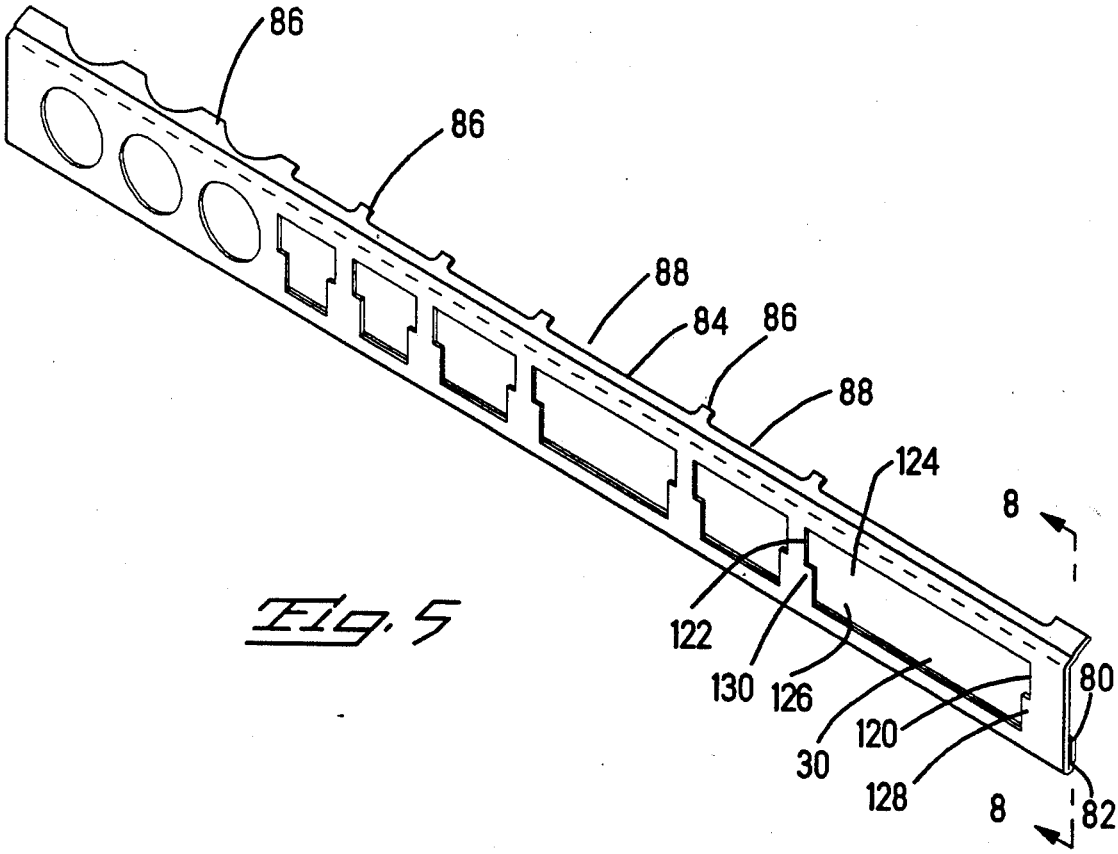
Fig. 5

HARDWARELESS PANEL RETENTION FOR SHIELDED CONNECTOR

BACKGROUND OF THE INVENTION

This invention relates to securing one or more connectors to a panel and in particular to securing a shielded connector or connector to a panel without the use of hardware such as clips or bolts and nuts.

U.S. Pat. No. 4,761,144 discloses a floating electrical connector capable of being inserted into and reliably retained within an opening in a panel without separate fastening means. Connectors have been mounted internally to an enclosure with access to the connector through an aperture in the panel. Other connectors have been mounted to panels using hardware such as clips in U.S. Pat. No. 4,241,972 or bolts and nuts as in U.S. Pat. No. 4,781,626.

SUMMARY OF THE INVENTION

In accordance with the present invention, a hardwareless panel retention system is provided in which an electrically conductive panel has opposed major surfaces with at least one mating connector aperture extending therebetween. The panel has opposed edges formed into a pair connector receiving of channels. A connector having a housing with contacts secured therein is secured to the panel adjacent to the at least one aperture. A shield secured to the connector housing has a opposed edges for receipt in respective opposed channels of the panel to secure the connector to the panel.

BRIEF DESCRIPTION OF THE DRAWING

FIG. 4 is a mating end view of the connector of FIG. 2;

FIG. 5 is a perspective view of a panel prior to insertion of the connectors;

FIG. 13 shows a rear view of the panel with connectors secured thereto; and

DESCRIPTION OF THE PREFERRED EMBODIMENT

Figure 1:
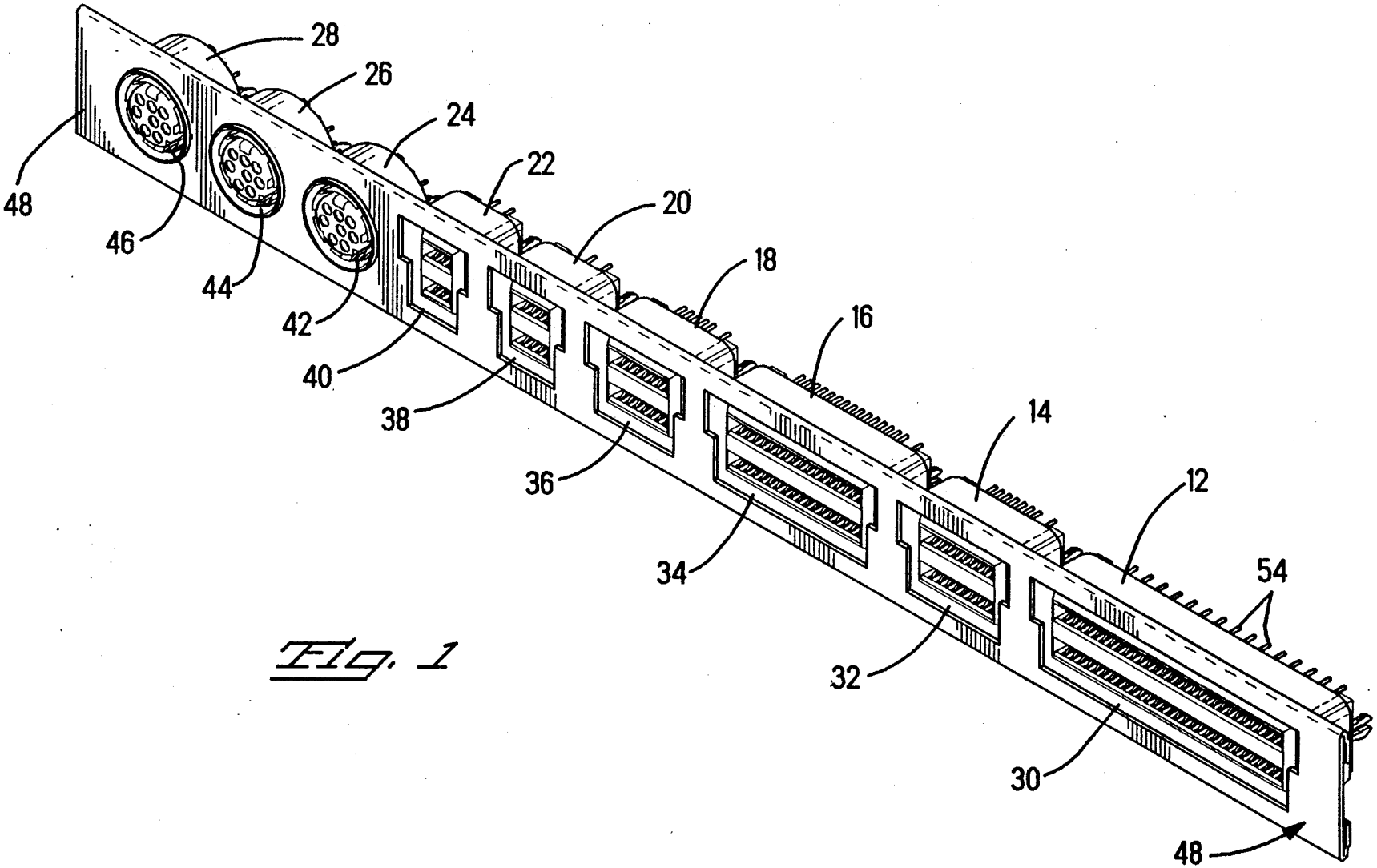
FIG. 1 is a perspective view showing a hardwareless panel retention for a plurality of shielded connectors, in accordance with the present invention.

A hardwareless panel retention system 10 for one or more connectors in shown in FIG. 1. Each connector 12–28 is mounted adjacent to a corresponding aperture 30–46 in panel 48. A complementary connector passes through the respective corresponding aperture to mate with a particular one of the connectors. For example, complementary cable terminated connector 50 shown in FIG. 13 will pass through aperture 30 to mate with connector 12.

Figure 2:
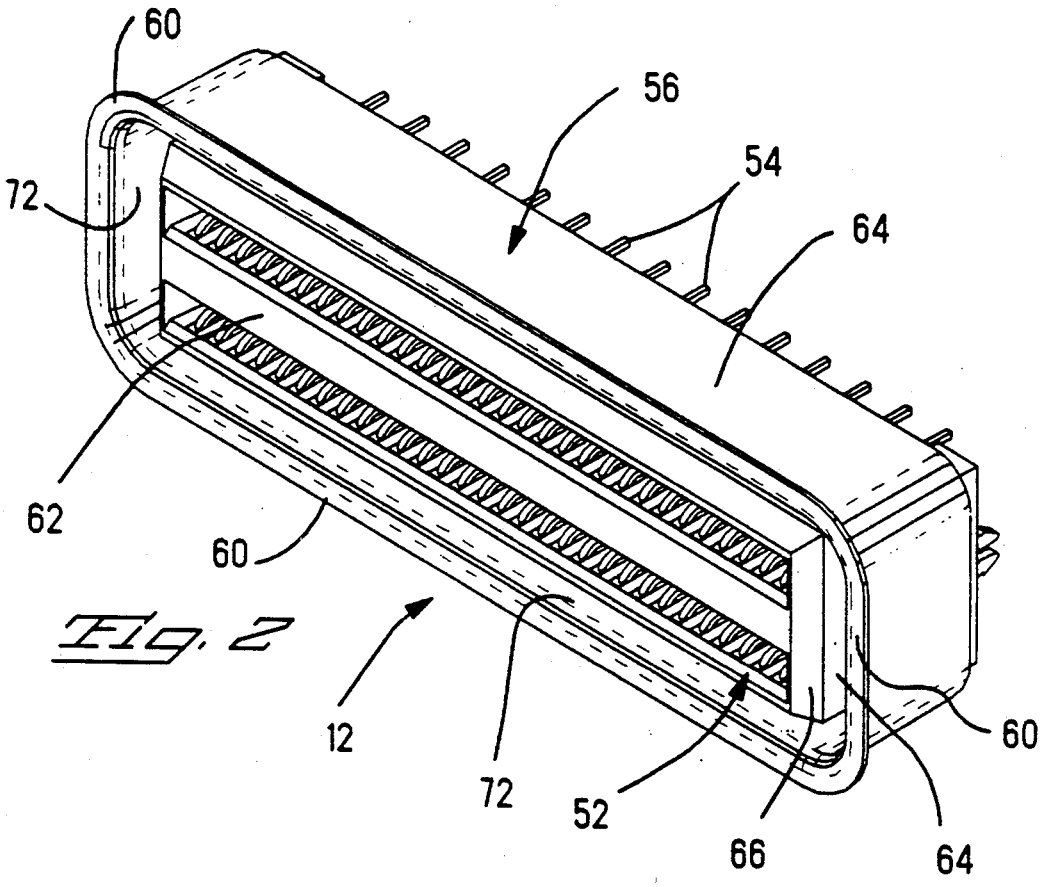
FIG. 2 is a perspective view of a connector adapted to be mounted to a panel by hardware retention.

As shown in the perspective view of FIG. 2, connector 12 includes a dielectric housing 52, contacts 54 and an electrically conductive shield 56. Housing 52 may be a slight modification of a known housing having known contacts 54 secured therein as taught by U.S. patent application Ser. No. 07/625,567 entitled Reduced Insertion Force Electrical Connector, filed Dec. 11, 1990, the disclosure of which is hereby incorporated by reference. Shield 56 in the preferred embodiment is made of steel, but could be made of any suitable electrically conductive material.

Shield 56 is formed to have housing receiving aperture 58 in the rear and an outward turned flange 60 as best seen in the cross section 53. Flange 60 in the preferred embodiment extends along at least opposite edges of shield 56. Mating face 62 may be coplanar with the plane of flange 62, recesses within shield 56 or extend beyond the shield. In the preferred embodiment shown in FIG. 1, the mating face of connector 12 extends beyond the plane of flange 60 a distance substantially equal to the thickness of panel 48 with the result that the mating face of connector 12, or at least some of the connectors 12–18, are flush mounted with respect to panel 48. Proximate the intersection of peripheral walls 64 and mating face 62 are bevelled lead-ins 66 which cooperate with the leading edge of the shield of a complementary connector during mating to align the contacts of the respective connectors for mating.

Figure 3:
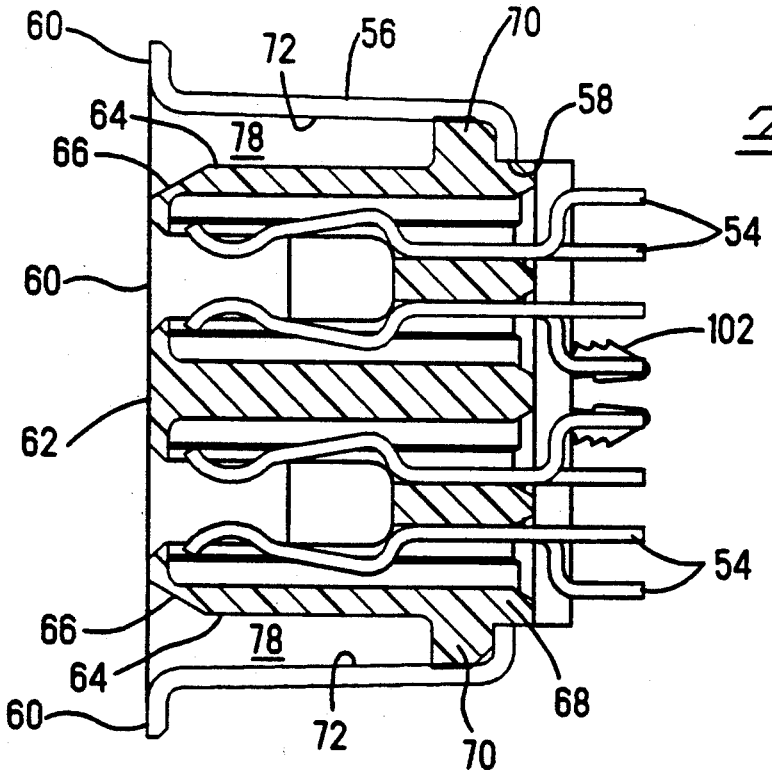
FIG. 3 is a side sectional view of the connector of FIG. 2.

With the rear portion 68 of housing 52 received in aperture 58, shield 56 is secured to housing 52 in any known manner, such as by an interference fit between flange 70 and the inside surface 72 of shield 56. The somewhat annular cavity 78 (best seen in FIGS. 3 and 4) between periphery walls 64 and inside surface 72 is sized to receive the shield 74 of mating connector 50. Shield 74 may have an outward projection 76 or shield 56 may have inward projections (not shown) as are known to enhance mechanical engagement therebetween and in turn assure electrical continuity therebetween.

Figure 6:
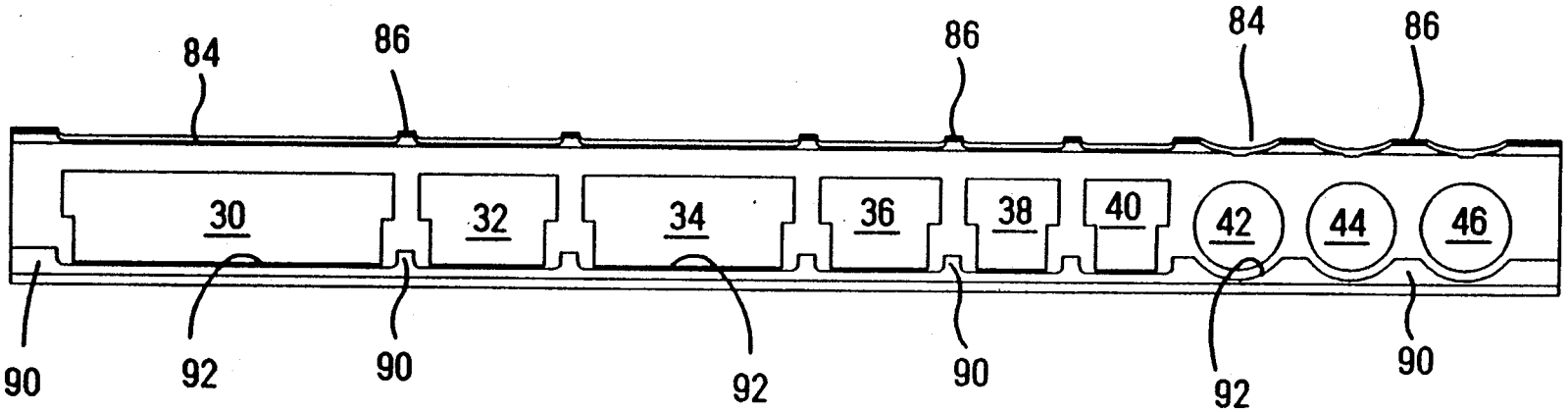
FIG. 6 is a rear view of the panel of FIG. 5.
Figure 7:
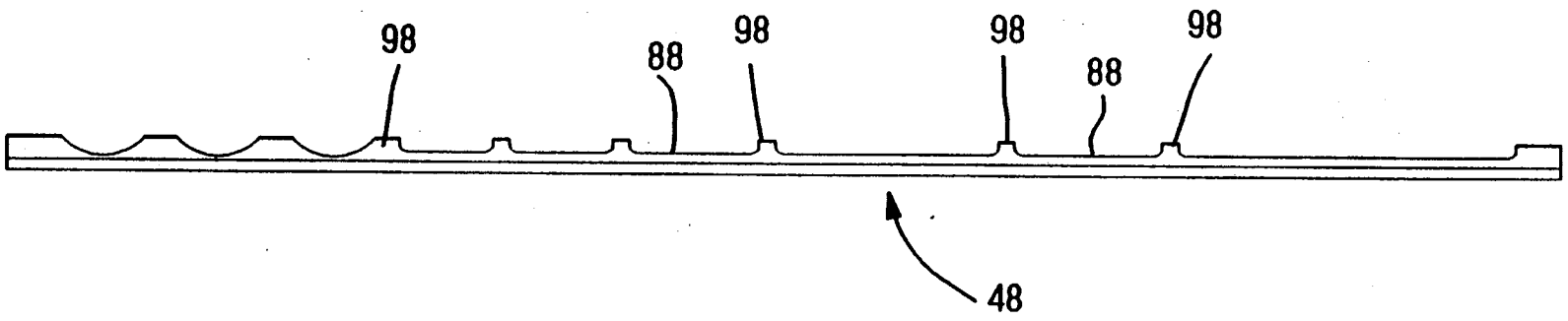
FIG. 7 is a top view of the panel of FIG. 5.
Figure 8:
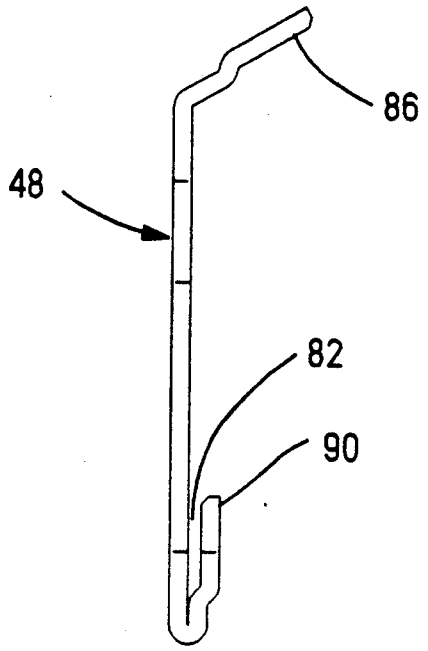
FIG. 8 is an end view of the panel of FIG. 5.

FIG. 5 shows a front perspective view of panel 48 having apertures 30–46 extending between major surfaces of the panel formed therein. The lower edge 80 of panel 48 has been formed over and rearwardly, upwardly defining channel 82 as seen at the right end of panel 48 and in FIG. 8. In a preferred embodiment, channel 82 has a gap between spaced surfaces of panel 48 that is substantially the thickness of or less than the thickness of flange 60 received therein. A typical channel may define a gap of 0.016 inches to receive connector flanges ranging between 0.018 and 0.022 inches. The upper edge 84 of panel 48 has been formed rearwardly out of the plan of the major portion of plate 48 having the apertures therein. The upper edge 84 is formed to an oblique angle to permit insertion and positioning of connectors in channel 82. Upper tabs 86 extend from upper edge 84 between adjacent apertures. Recesses 88, seen best in FIGS. 5–7, between tabs 86 accommodate the shield of a connector. Similarly lower tabs 90 extend from lower edge 80 between adjacent apertures and opposite tabs 86. Recesses 92 between tabs 90 accommodate connectors. The formed edge of panel 48 as well as tabs provide spring members to press flange 60 against the inside surface of panel 48.

Figure 9:
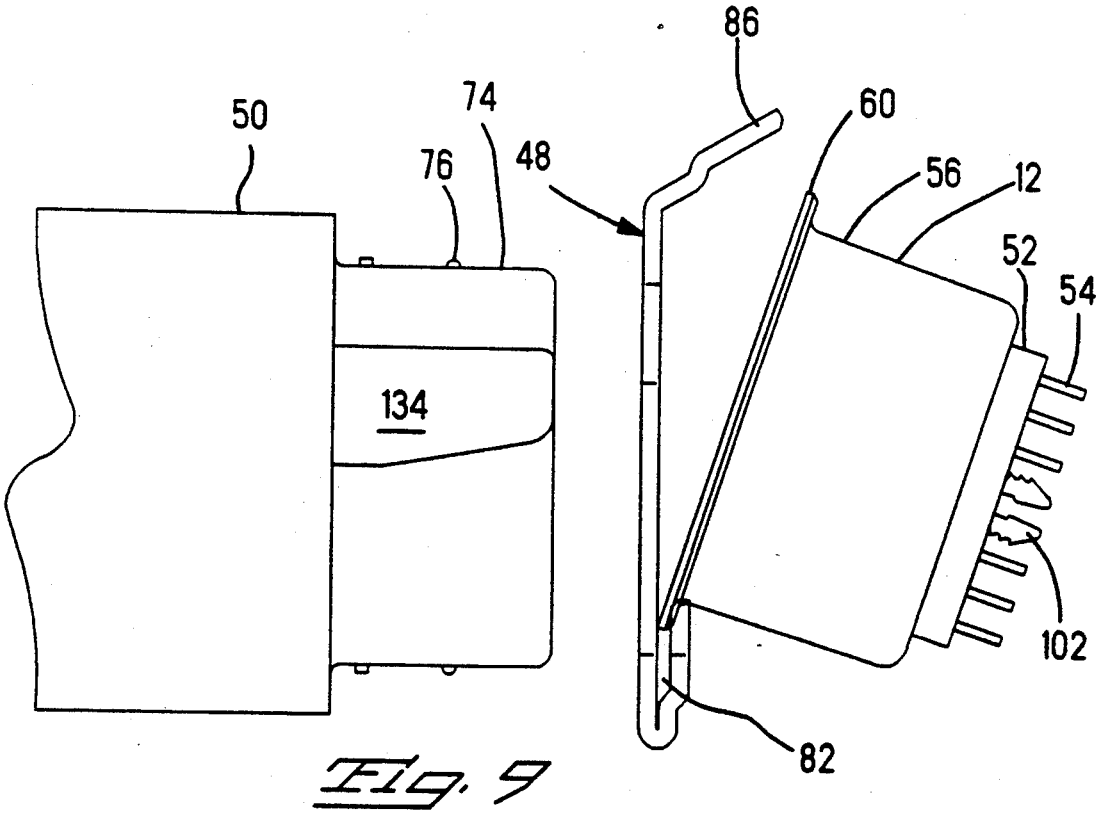
FIGS. 9–11 are an action sequence showing a side view of a connector being positioned in the panel and the upper tabs being formed to secure the connector to the panel.
Figure 10:
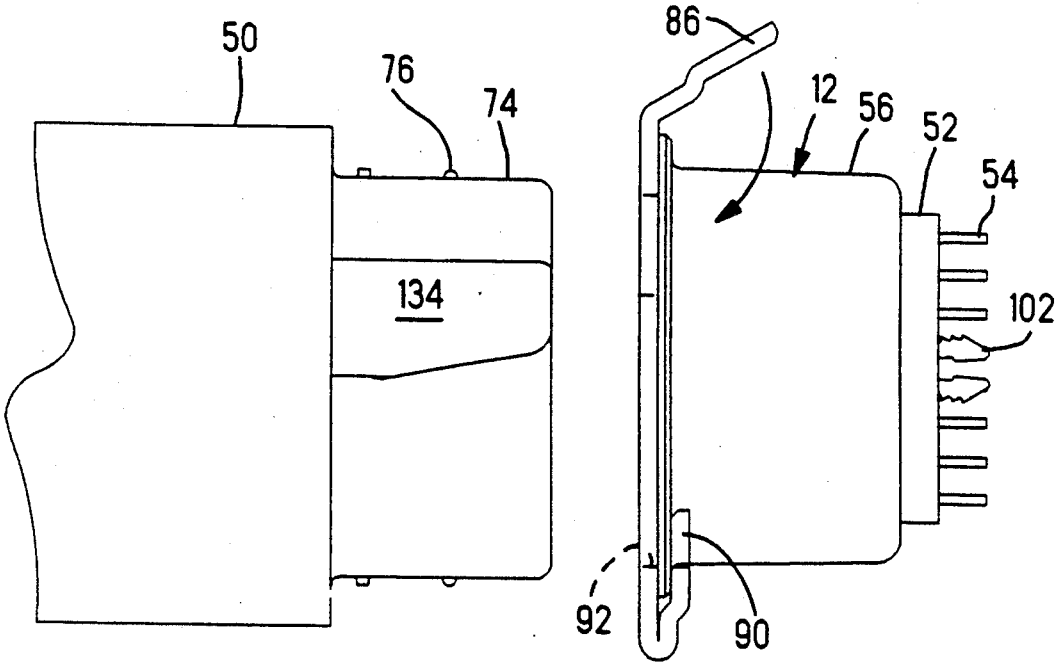

Connectors are secured to panels 48 by first inserting a connector behind a corresponding aperture such as connector 12 behind aperture 30. With the connector 12 at an angle relative to panel 48 as shown in FIG. 9, a first, lower portion of flange 60 is inserted into channel 82. Connector 12 is subsequently rotated, counterclockwise in FIG. 9, until flange 60 engages the rear surface of panel 48 as shown in FIG. 10. When panel 48 accommodates additional connectors, the additional connectors are then positioned in channel 82 adjacent to a respective aperture in a similar manner.

Figure 11:
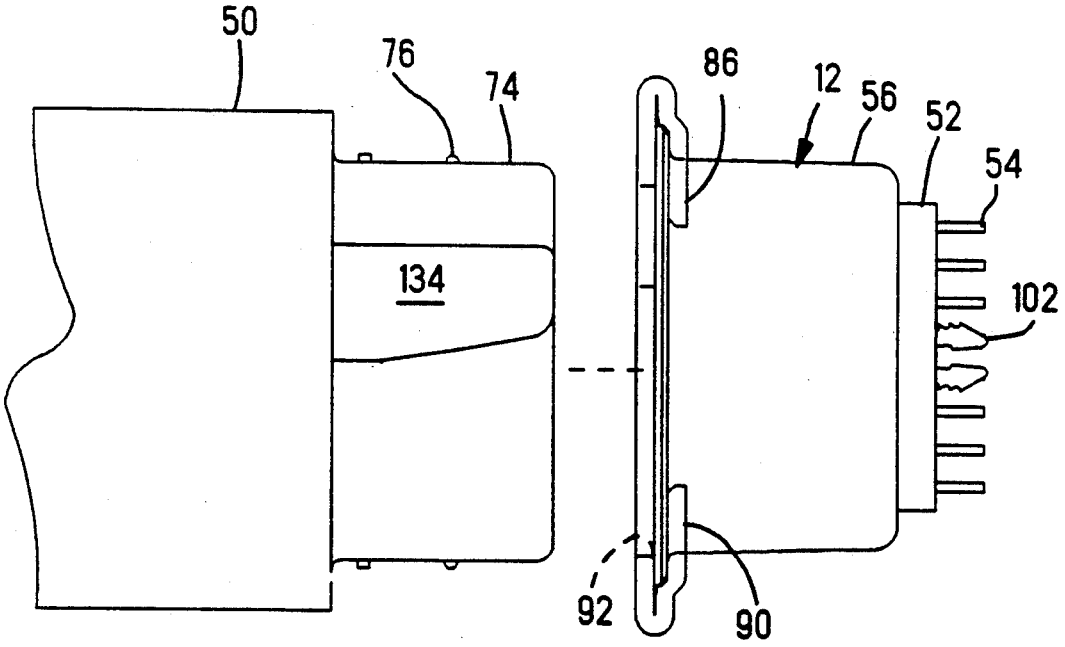

As shown in FIG. 11, upper edge 84 of panel 48 is then formed or crimped downward over a second, upper portion of flange 60 forming channel 94 with upper tabs 86 extending along a vertical portion of flange 60. Channel 94 is formed to be substantially the thickness of flange 60. Since the recesses 88,92 conform to the shape of a connector, flange 60 along each of the upper and lower edges is captured between surfaces of plate 48 in channels 82 and 94. With the flange around the periphery of shield 56 pressed against the rear surface of panel 48, very effective shielding is achieved. Tabs 86 and 90 enhance the retention of connectors on panel 48.

Figure 12:
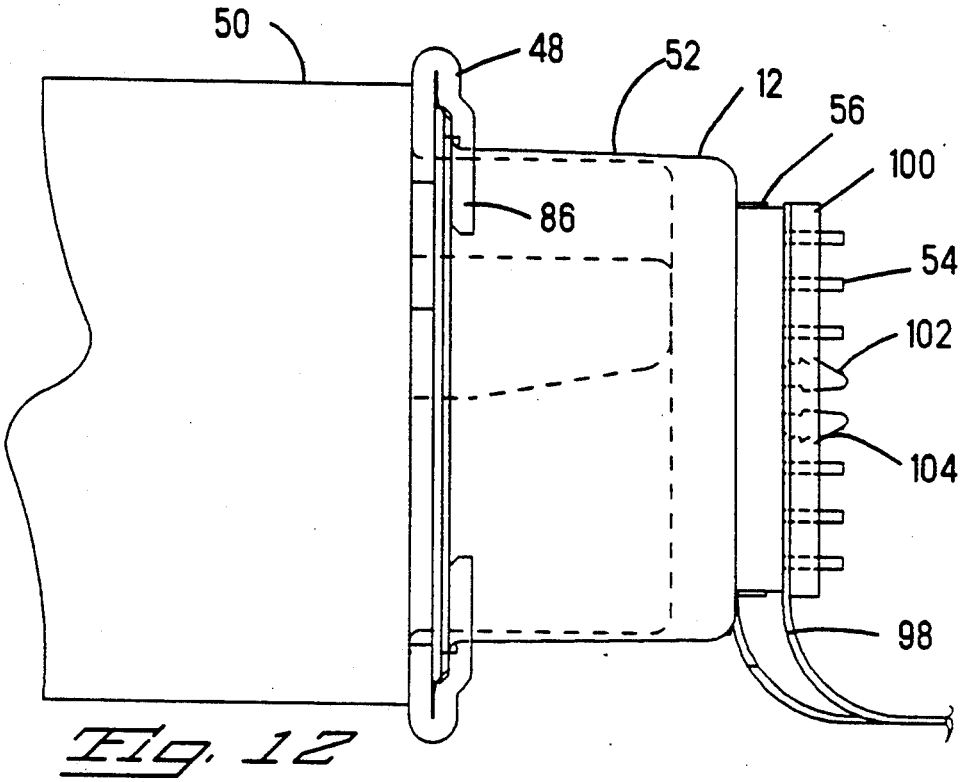
FIG. 12 shows a side view of the connector secured to a panel mated with a complementary connector and having the contacts of the connector interconnected to traces on a medium.
Figure 14:
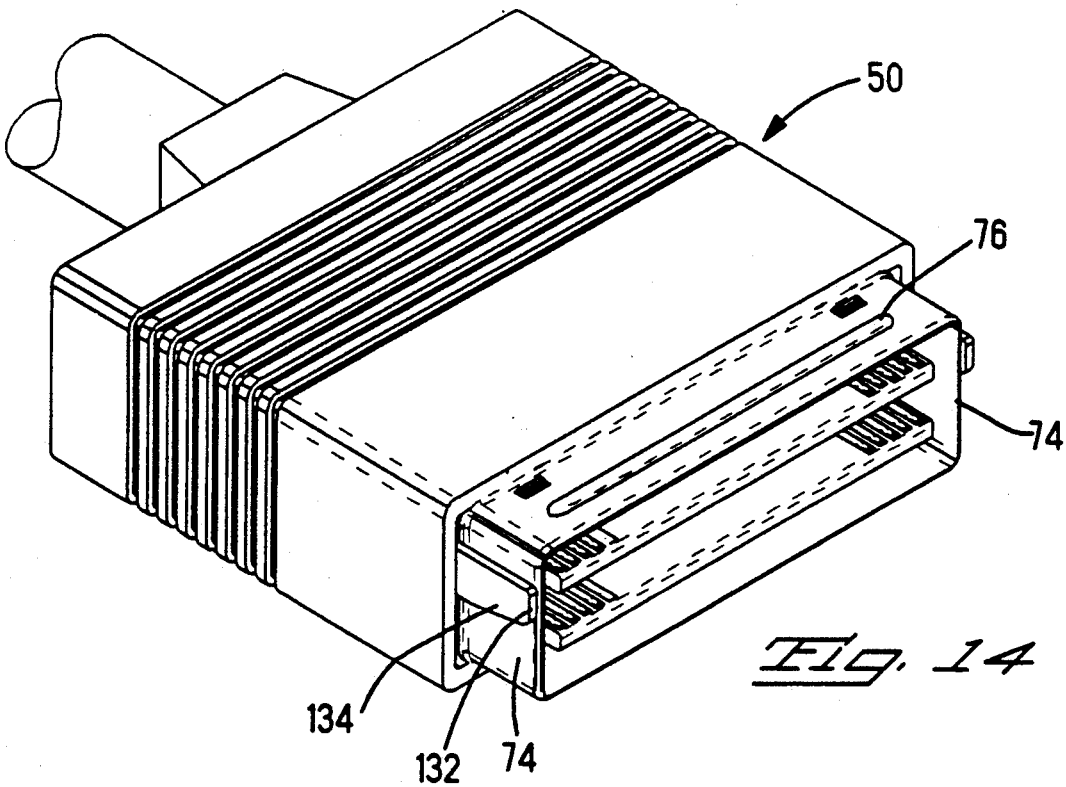
FIG. 14 shows a front perspective view of a mating connector to mate with one of the connectors secured to the panel in FIG. 1.
Figure 17:
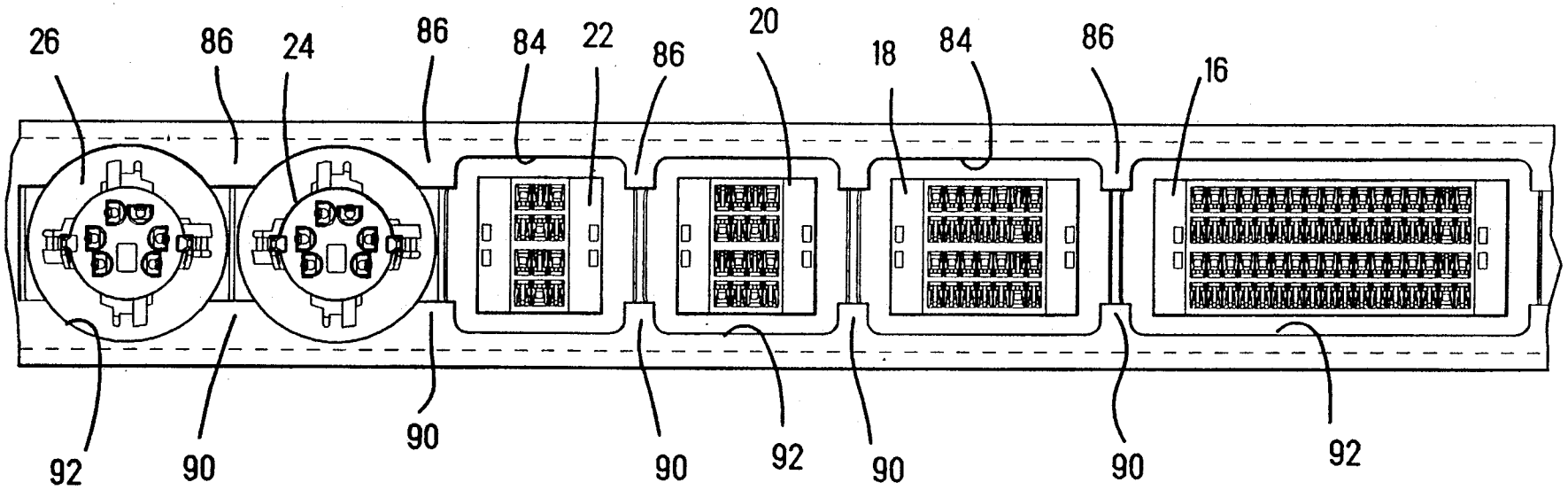

Contacts 54 may be conductive with traces on a circuit board or, as shown in FIG. 12, with traces 96 on flexible film laminate 98. When flexible film laminate 98 is used, a back-up epoxy resin board 100 is used to maintain flexible film laminate 98 on the contacts. This achieved by boardlock 102 being received in an aperture 104 of epoxy resin board 100 with barbs on boardlock 102 engaging the sidewall of aperture 104 to secure the epoxy resin board to the connector with the flexible film laminate pressed against the bottom surface of the connector. FIG. 12 also shows a complementary connector mated to connector 12 through panel aperture 30.

FIG. 13 shows a rear view of panel 48 with connectors 12–28 secured thereto. In this view it is more evident how the edges 80 and 84 as well as tabs 86 and 90 cooperate with flange 60 on the connectors to secure the connectors to the panel.

Panel 48 can be mounted in a chassis by hardware or by being captured along edge surfaces, with access to panel 48 in connectors 12–28 for mating with complementary connectors.

While the formation of channels 82 and 94 have been described as folding an edge of panel 48, tab-like members could be formed out of portions of panel 48 to achieve the same function.

We claim:

1. A hardwareless panel retention system comprising:

an electrically conductive panel, said panel having opposed major surfaces with a mating connector receiving aperture extending therebetween, said panel having opposed edges formed into a pair of opposed channels by edges of the panel folded through approximately 180 degrees;

a connector housing having contacts secured therein;

a shield secured to said connector housing, said shield having a flange member extending along opposed edges for receipt in respective opposed channels in the panel to secure the connector to the panel.

2. A hardwareless panel retention system as recited in claim 1, wherein the flanges on the shield extend outwardly from the field.

3. A hardwareless panel retention system as recited in claim 1, wherein the channels define a gap between said folded edges and the panel that is smaller than the thickness of the connector flange received therein, whereby mechanical engagement between the shield and panel is assured to provide electrical conductivity therebetween.

4. A hardwareless panel retention system, comprising:

an electrically conductive panel, said panel having opposed major surfaces with at least one mating connector receiving aperture extending therebetween, said panel having opposed edges proximate said at least one aperture formed into a pair of opposed channels by edges of the panel folded through approximately 180 degrees;

a connector housing having contacts secured therein;

a shield secured to said connector housing, said shield having a flange member extending along opposed edges for receipt in said opposed channels in the panel to secure the connector to the panel proximate said at least one mating connector receiving aperture.

5. A hardwareless panel retention system as recited in claim 4, wherein the channels define a gap between said folded edges and the panel that is smaller than the thickness of the connector flange received therein, whereby mechanical engagement between the shield and the panel is assured to provide electrical conductivity therebetween.

* * * * *